US010895110B2

(12) United States Patent
Lanzafame

(10) Patent No.: US 10,895,110 B2
(45) **Date of Patent: *Jan. 19, 2021**

(54) LADDER STABILIZER

(71) Applicant: Philip F. Lanzafame, Poulsbo, WA (US)

(72) Inventor: Philip F. Lanzafame, Poulsbo, WA (US)

(73) Assignee: Philip F. Lanzafame, Poulsbo, WA (US)

( * ) Notice: Subject to any disclaimer, the term of this patent is extended or adjusted under 35 U.S.C. 154(b) by 126 days.

This patent is subject to a terminal disclaimer.

(21) Appl. No.: 16/150,907

(22) Filed: Oct. 3, 2018

(65) Prior Publication Data

US 2019/0040682 A1 Feb. 7, 2019

Related U.S. Application Data

(63) Continuation of application No. 15/297,389, filed on Oct. 19, 2016, now Pat. No. 10,107,035.

(60) Provisional application No. 62/389,840, filed on Mar. 11, 2016, provisional application No. 62/285,042, filed on Oct. 19, 2015.

(51) Int. Cl.

| | |
|---|---|
| ***E06C 7/42*** | (2006.01) |
| ***E06C 7/44*** | (2006.01) |
| ***E06C 7/10*** | (2006.01) |

(52) U.S. Cl.

CPC ..... *E06C 7/423* (2013.01); *E06C 7/10* (2013.01); *E06C 7/42* (2013.01); *E06C 7/426* (2013.01); *E06C 7/44* (2013.01)

(58) Field of Classification Search

CPC . E06C 7/423; E06C 7/42; E06C 7/426; E06C 7/44; E06C 7/10; E06C 1/14; E06C 1/16; E06C 1/18; E06C 1/20; E06C 1/22; E06C 1/24; E06C 1/26; E06C 1/28; E06C 1/30; E06C 1/32

See application file for complete search history.

(56) References Cited

U.S. PATENT DOCUMENTS

| | | | | | |
|---|---|---|---|---|---|
| 979,821 | A * | 12/1910 | Brasington | E06C 7/44 | 182/205 |
| 1,385,319 | A * | 7/1921 | Enke | E06C 1/20 | 182/172 |
| 2,885,133 | A * | 5/1959 | Nelson | A01D 46/243 | 182/169 |
| 3,508,628 | A * | 4/1970 | Conrad | E06C 7/423 | 182/172 |
| 3,933,221 | A * | 1/1976 | Sorenson | E06C 7/42 | 182/172 |
| 4,014,406 | A * | 3/1977 | Easton | E06C 7/44 | 182/204 |

(Continued)

*Primary Examiner* — Katherine W Mitchell
*Assistant Examiner* — Shiref M Mekhaeil
(74) *Attorney, Agent, or Firm* — Tucker Ellis LLP; Carlos Garritano; Patrick Clunk

(57) ABSTRACT

Provided is ladder having an extension leg movable longitudinally in first and second directions opposite one another, and a stabilizer arm pivotably coupled to and movable with the extension leg. The stabilizer arm is pivotable about an axis perpendicular to the first and second directions such that the stabilizer arm is rotated relative to the extension leg to contact a surface to stabilize the ladder in a sideways direction perpendicular to the first and second directions.

18 Claims, 16 Drawing Sheets

(56) References Cited

U.S. PATENT DOCUMENTS

| | | | | | |
|---|---|---|---|---|---|
| 4,147,231 | A * | 4/1979 | Chantler | E06C 7/423 | 182/107 |
| 4,244,446 | A * | 1/1981 | Mair | E06C 7/423 | 182/172 |
| 4,607,726 | A * | 8/1986 | Davis | E06C 7/44 | 182/204 |
| 5,341,899 | A * | 8/1994 | Casamento | E06C 7/003 | 182/107 |
| 5,678,656 | A * | 10/1997 | Lanzafame | E06C 7/44 | 182/111 |
| 5,704,451 | A * | 1/1998 | King | E06C 7/44 | 182/111 |
| 6,450,292 | B1 * | 9/2002 | Sheffield | E06C 7/44 | 182/200 |
| 7,216,742 | B2 * | 5/2007 | Spengler | E06C 1/39 | 182/172 |
| 9,145,733 | B2 * | 9/2015 | Worthington | E06C 7/423 | |
| 9,988,842 | B2 * | 6/2018 | Moss | E06C 7/48 | |
| 10,590,702 | B2 * | 3/2020 | Major | E06C 7/423 | |
| 2001/0002086 | A1 * | 5/2001 | Webb | B66C 23/80 | 280/765.1 |
| 2009/0107765 | A1 * | 4/2009 | Germond | E06C 7/423 | 182/172 |
| 2010/0038172 | A1 * | 2/2010 | Ralston | E06C 7/46 | 182/107 |
| 2010/0116592 | A1 * | 5/2010 | Clements | E06C 7/44 | 182/180.1 |
| 2015/0252620 | A1 * | 9/2015 | Walsh | E06C 7/423 | 182/107 |
| 2017/0335627 | A1 * | 11/2017 | Parker | E06C 7/426 | |

* cited by examiner

LADDER STABILIZER

RELATED APPLICATIONS

This application is a continuation of U.S. patent application Ser. No. 15/297,389 filed on Oct. 19, 2016, which claims priority to and the benefit of U.S. Provisional Application Ser. No. 62/285,042 filed on Oct. 19, 2015 and U.S. Provisional Application Ser. No. 62/389,840 filed on Mar. 11, 2016. The entireties of such applications are incorporated herein by reference.

FIELD OF INVENTION

The present invention relates generally to a removable attachment for each leg of a ladder, and more particularly to a removable attachment to each leg of a ladder and each removable attachment extends a height of each leg of the ladder to adjust and compensate for uneven surfaces and includes a stabilizer arm to provide stabilization to the ladder.

BACKGROUND

In construction, painting, utility servicing, building maintenance and other occupations where a ladder is used to perform work, the placement of the ladder is often a problem. For example, the ladder may need to be placed upon uneven or inclined surfaces for work to be performed, such as on a stair, which results in rails of the ladder not being positioned vertically leading to the ladder falling. To position the rails of the ladder vertically to reduce injury, a ladder leveling device may be used.

SUMMARY OF INVENTION

The present application provides an adjustable extension for a ladder leg having an outer housing, an inner housing movable longitudinally relative to the outer housing in first and second directions opposite one another, and a stabilizer arm pivotably coupled to and movable with the inner housing. The stabilizer arm is pivotable about an axis perpendicular to the first and second directions such that the stabilizer arm is rotated relative to the inner housing to contact a surface to stabilize the extension in a sideways direction perpendicular to the first and second directions.

According to one aspect, an adjustable extension for a ladder leg is provided that includes an outer housing, an inner housing movable longitudinally relative to the outer housing in first and second directions opposite one another, and a stabilizer arm pivotably coupled to and movable with the inner housing, the stabilizer arm being pivotable about an axis perpendicular to the first and second directions such that the stabilizer arm is rotated relative to the inner housing to contact a surface to stabilize the extension in a sideways direction perpendicular to the first and second directions.

According to another aspect, an adjustable extension for a ladder leg is provided that includes an extension leg movable longitudinally relative to the ladder leg in first and second directions opposite one another, and a stabilizer arm having a first end and a second end and being a fixed length, the stabilizer arm being pivotably coupled to the extension leg at the first end and movable with the extension leg, wherein the stabilizer arm is rotatable relative to the extension leg to contact a surface to stabilize the extension in a sideways direction perpendicular to the first and second directions.

According to still another aspect, a stabilizer system is provided that includes a stabilizer arm having a first end and a second end and being a fixed length, and a shoe connected to the second end of the stabilizer arm for gripping a surface when the stabilizer arm is in a deployed position, wherein the stabilizer arm is configured to be pivotally coupled to a ladder or ladder extension at the first end of the stabilizer arm, and wherein the stabilizer arm is movable between a stowed position substantially parallel to the ladder or ladder extension and the deployed position wherein the stabilizer arm is rotated about an axis substantially perpendicular to the ladder or ladder extension to provide side to side stabilization.

The foregoing and other features of the application are described below with reference to the drawings.

DETAILED DESCRIPTION

Figure 1:
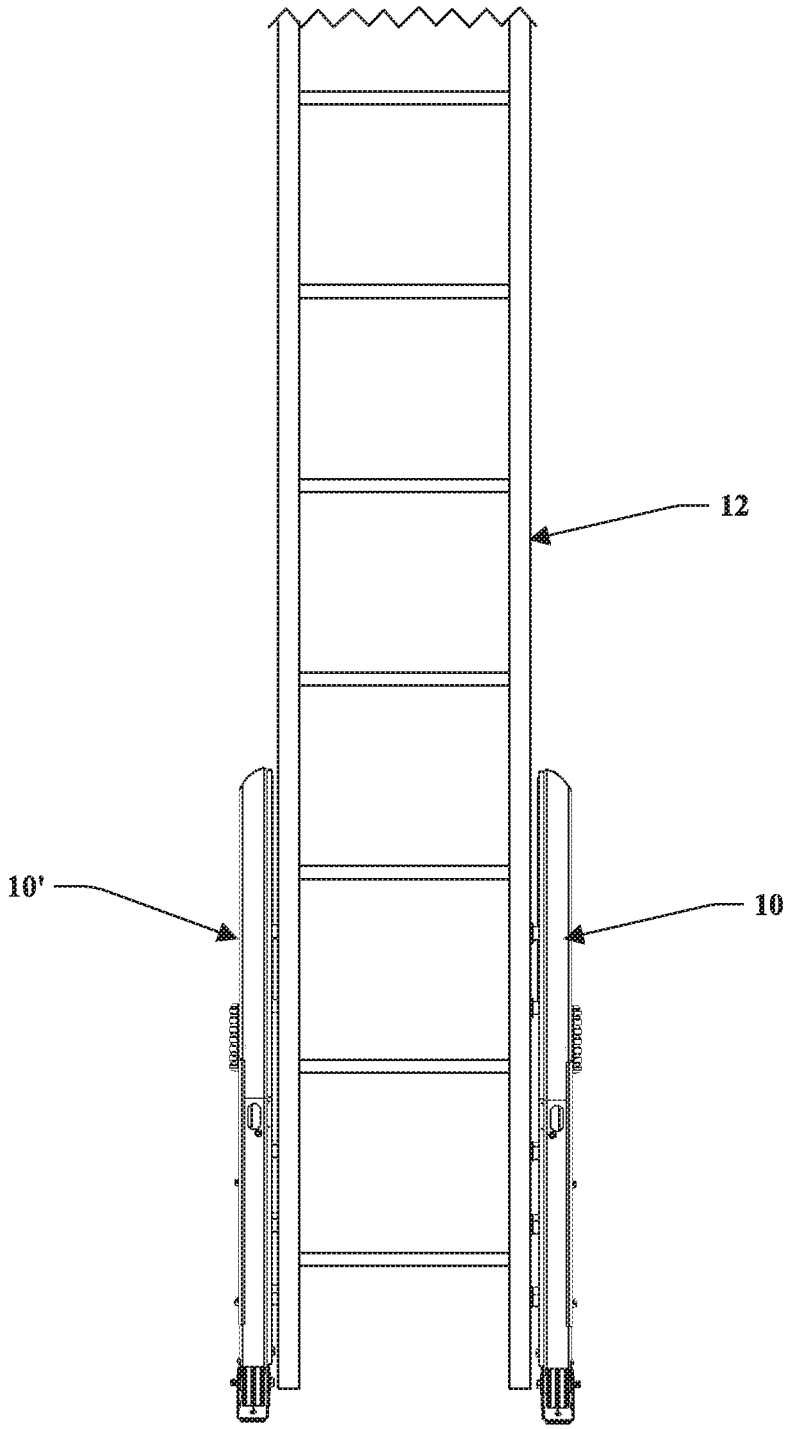
FIG. 1 is a side view of an exemplary adjustable extensions attached to legs of a ladder.

The principles of the present application relate to stabilizing, extending, and leveling a leg of a ladder, and thus will be described below in this context. It will be appreciated that the principles of the application may be applicable to other apparatuses requiring stabilizing, extending, and leveling, such as scaffolding.

Referring initially to FIGS. 1-8, an exemplary adjustable extension is illustrated generally at reference numeral 10. The adjustable extension 10 (also referred to as "extension 10") is connected to a ladder 12, which may be any suitable ladder, as will be described below. In use, one extension 10 may be connected to a left leg of the ladder 12 and one extension 10 may be connected to a right leg of the ladder 12 to provide stabilization, extension, and leveling to the ladder. In an embodiment, a first extension 10 is coupled to a first leg of a ladder and a second extension 10' is coupled to a second leg of a ladder. It is to be appreciated that if the following description describes an extension 10, such description can apply for an additional extension 10'. It is to be further appreciated that the extension 10 can be coupled to an inside of a leg of a ladder or an outside of a ladder of a leg. For example, a first extension 10 and a second extension 10' can be coupled to an inside of a first leg and an inside of a second leg respectively. In another example, a first extension 10 and a second extension 10' can be coupled to an outside of a first leg and an outside of a second leg respectively. In still another example, a first extension 10 and a second extension 10' can be coupled to an inside of a first leg and an outside of a second leg respectively or vice versa. In yet another example, the first and/or second extension 10 and 10' are incorporated into the leg of the ladder to provide extension/leveling and/or stabilization. Alternatively, in another embodiment, a stabilizer arm may be incorporated into the leg of the ladder.

Figure 2:
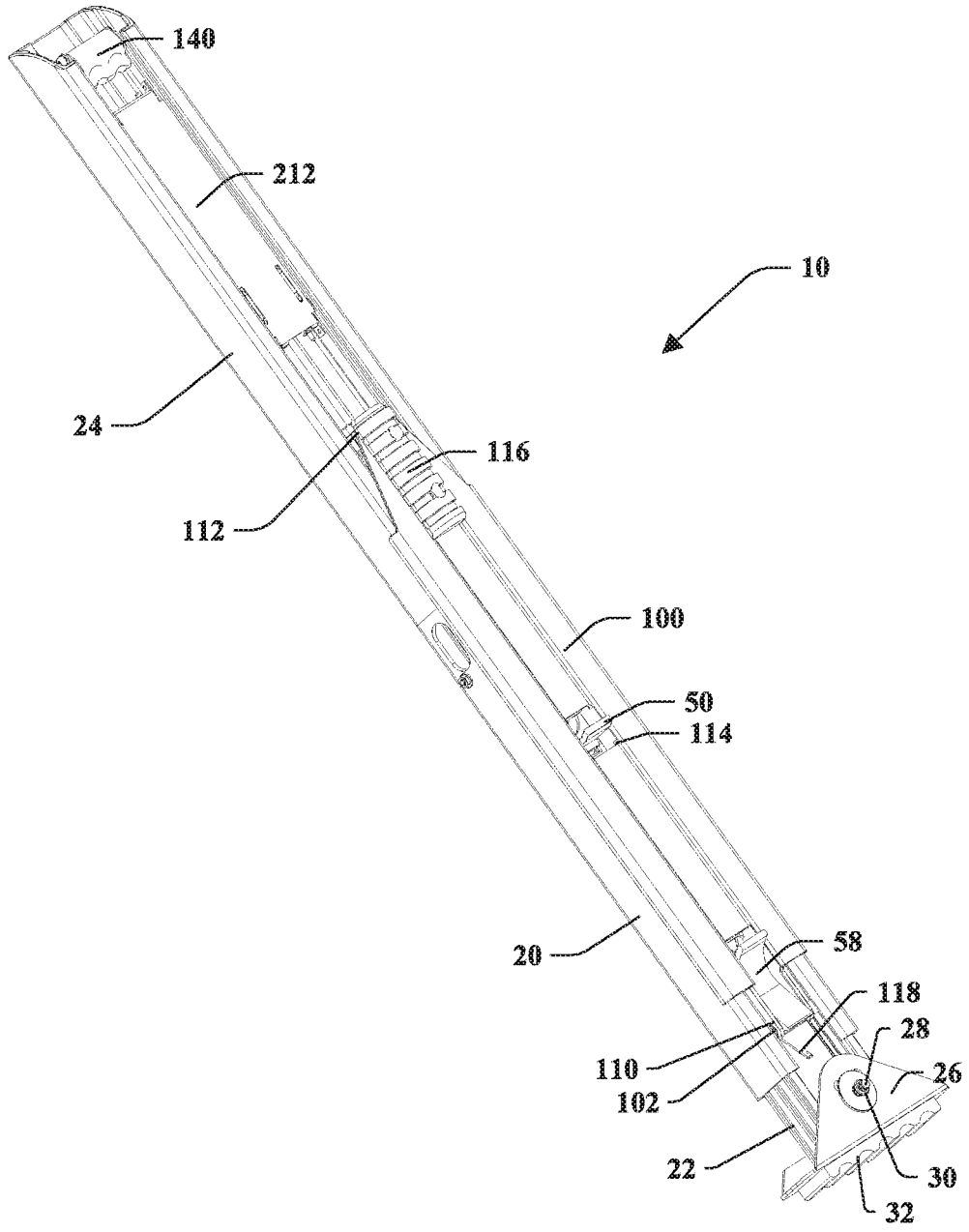
FIG. 2 is a perspective view of the adjustable extension with a stabilizer arm in a stowed position.
Figure 4:
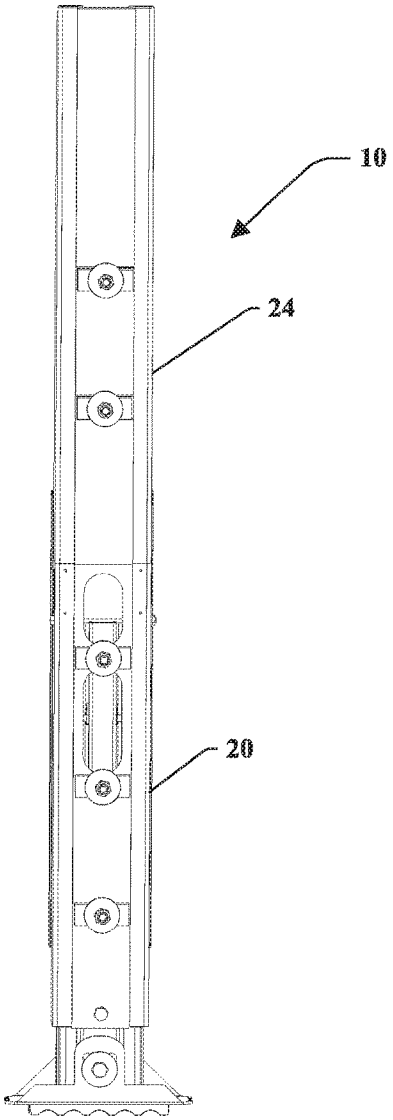
FIG. 4 is a back view of the adjustable extension.
Figure 3:
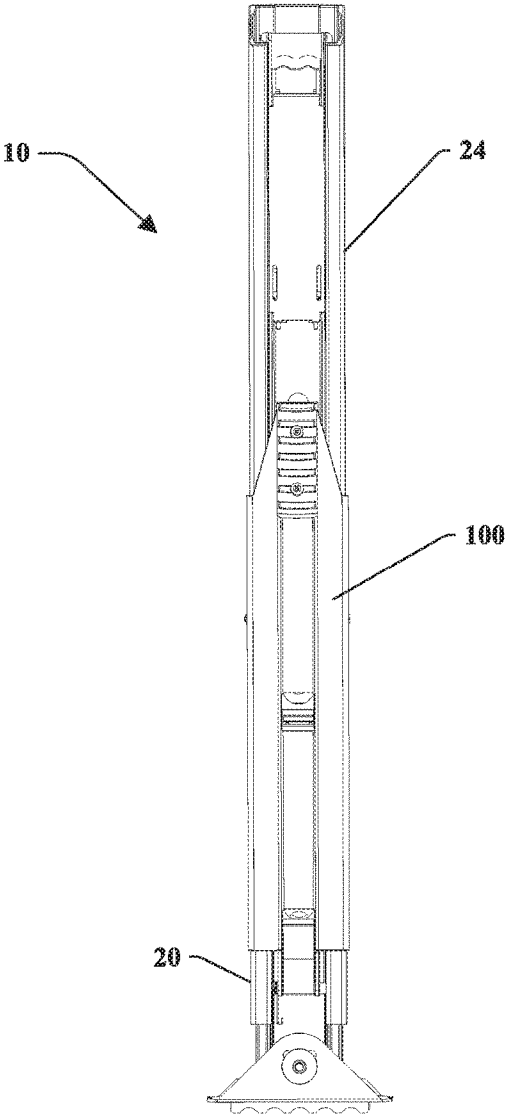
FIG. 3 is a front view of the adjustable extension.
Figure 5:
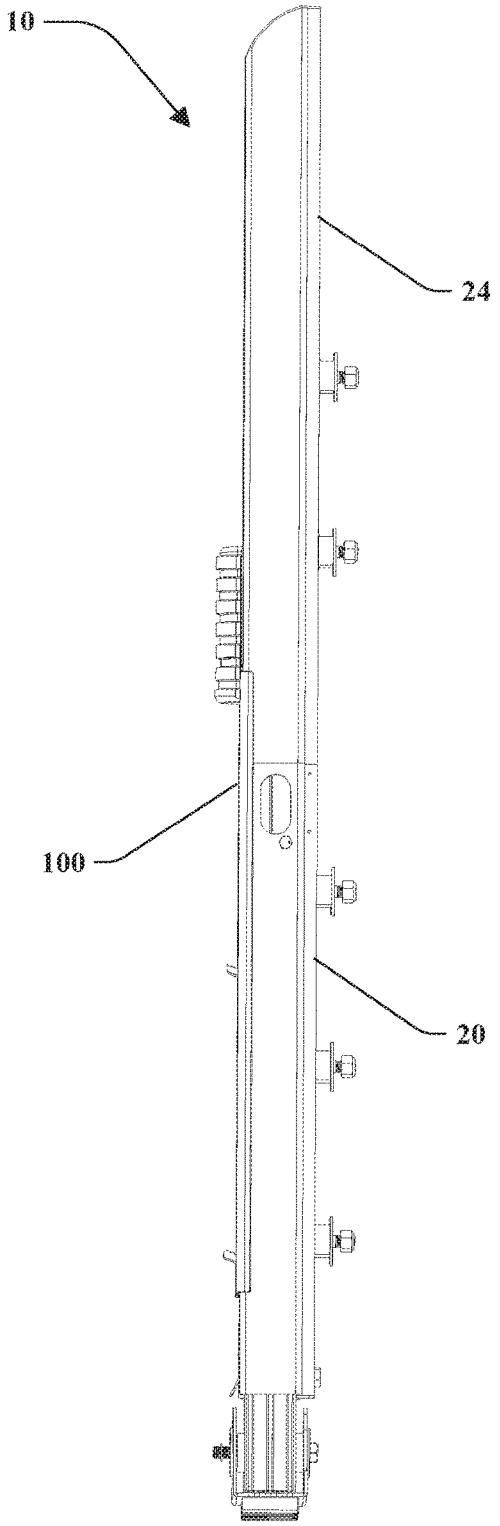
FIG. 5 is a right side view of the adjustable extension.
Figure 6:
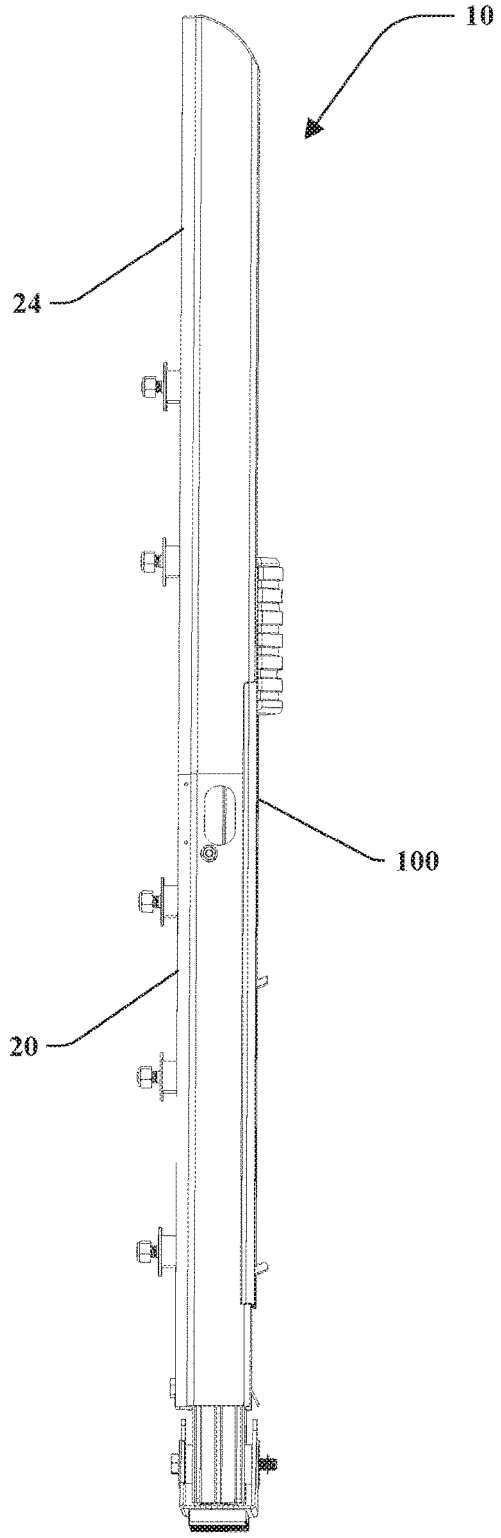
FIG. 6 is a left side view of the adjustable extension.
Figure 7:
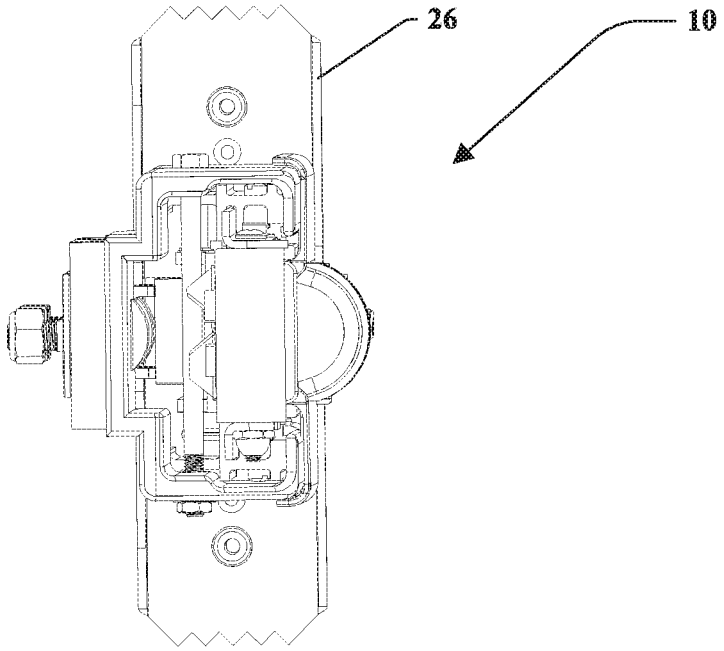
FIG. 7 is a top view of the adjustable extension.
Figure 8:
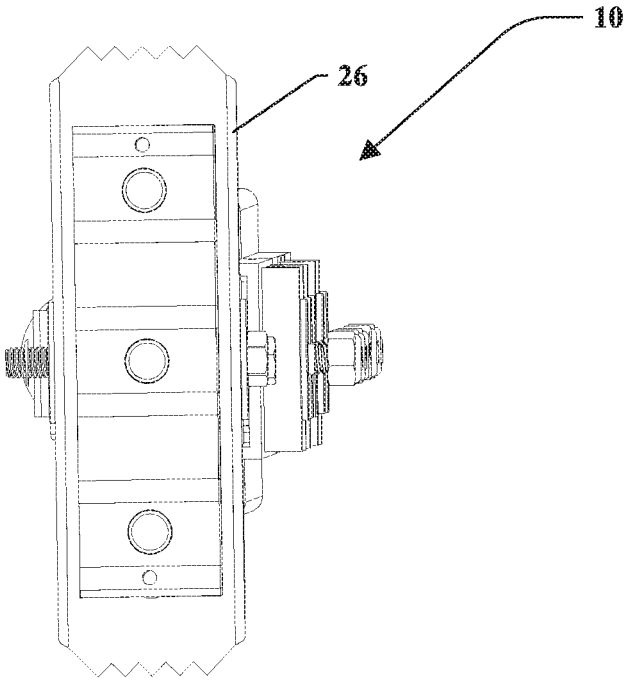
FIG. 8 is a bottom view of the adjustable extension.
Figures 9, 9A:
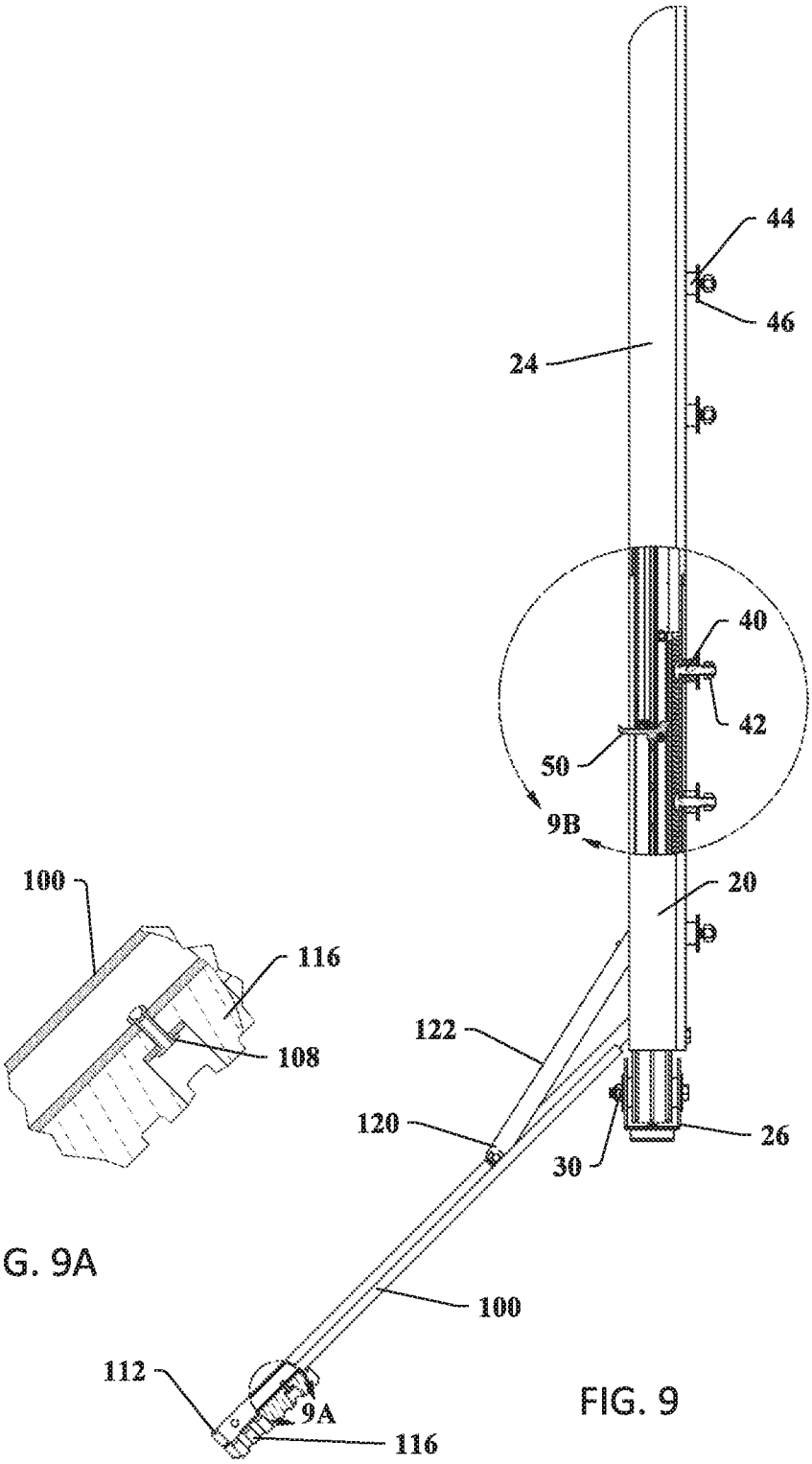
FIG. 9 is a side view of the adjustable extension with the stabilizer arm in a deployed position.
FIG. 9A is a cross-sectional view of detail 9A of FIG. 9.
Figure 10:
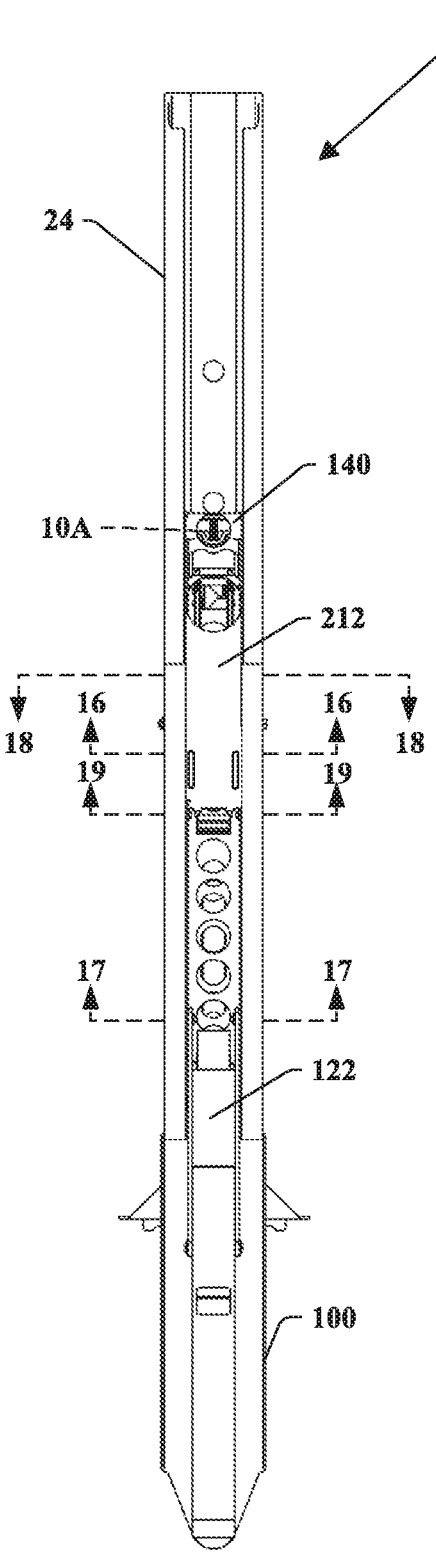
FIG. 10 is a front view of the adjustable extension with the stabilizer arm in the deployed position.

Turning now to FIGS. 8-10 in addition to FIG. 2, the adjustable extension includes an outer housing 20, an inner housing or extension leg 22 movable relative to the outer housing 20 to extend/retract the extension, a protective cap 24 coupled to the outer housing 20 to prevent damage to components of the extender, and a foot 26 attached to a bottom of the extension leg 22 and movable with the extension leg 22 during extension/retraction. The foot 26 has a pair of openings positioned on either side of the extension leg 22 through which a fastener 28, such as a bolt, extends and is held by nut 30 to secure the foot 26 to the extension leg 22 to allow the extension leg 22 to pivot relative to the foot 26 when the foot 26 is flat on a surface to provide leveling and extension. Attached to the bottom of the foot 26 is a friction pad 32 to provide grip. In an example, the foot 26 can be moveable in various directions.

Figure 9B:
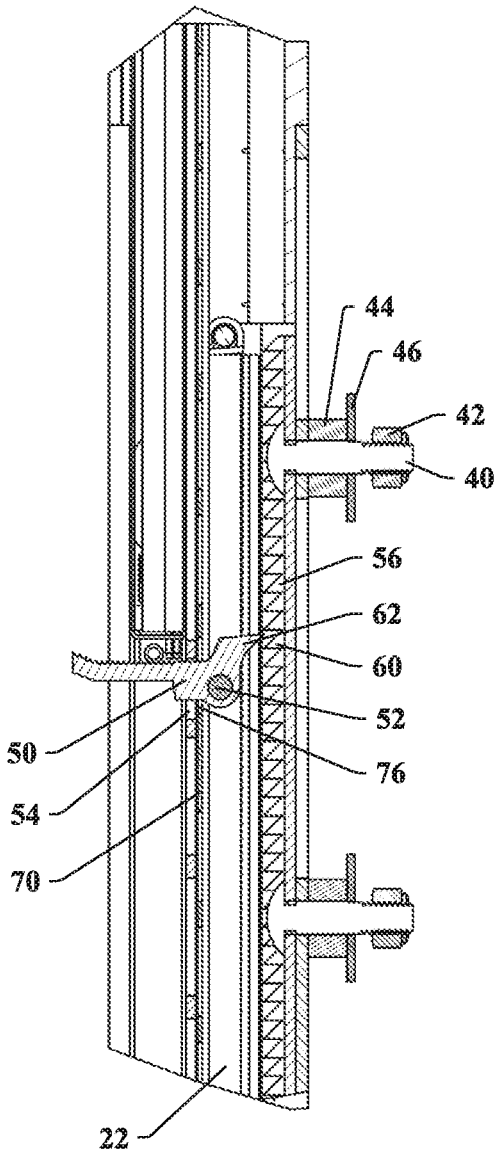
FIG. 9B is a cross-sectional view of detail 9B of FIG. 9.

As shown in FIGS. 9 and 9B, the outer housing 20 and the protective cap 24 are configured to be coupled to the leg of the ladder in any suitable manner, such as by suitable fasteners, such as by pairs of bolts 40 and nuts 42 extending through openings in and spaced along a length of the outer housing 20 and protective cap 24. The outer housing 20 and protective cap 24 can be spaced from the ladder 12 in any suitable manner, such as by spacers 44 and/or washers 46.

Referring now to FIGS. 2 and 9B, the adjustable extension 10 also includes a release lever 50 fastened to the extension leg 22 with a pivot pin 52 and extending through an aperture 54 in the leg 22, a locking hub rail 56 secured to the outer housing 20, for example by the bolts 40, and a release pedal 58. The locking hub rail 56 includes a plurality of locking nubs 60 along its length that are configured to be engaged by a locking tip 62 of the release lever 50 to lock the extension leg 22 relative to the outer housing 20. To facilitate the extension and retraction of the extension leg 22 into and out of the outer housing 20, the release pedal 58 may be folded down and pushed downward by the user, and the release pedal 58 may be folded up for storage or otherwise non-use of the ladder.

To lock the release lever 50 in position when the extension leg 22 is extended and a load is applied to the extension 10, a safety bar 70 is provided as shown in FIGS. 9B, 11, 11A, and 12. The safety bar 70 is movable longitudinally relative to the extension leg 22 a distance in a first direction and a second direction opposite the first direction until it contacts a stop on the extension leg 22, and prevented from moving in a direction perpendicular to the first and second directions by ledges 72 on the extension leg 22 that trap the safety bar 70. The safety bar 70 includes an opening 74 near a first end through which the fastener 28 extends coupling to safety bar 70 to the foot 26 and the extension leg 22, an opening 76 through which the release lever 50 extends, and tabs 78 at a second end for engaging and moving wedges 80 as will be discussed below. An opening 82 in the extension leg 22 through which the fastener 28 extends is elongated such that the opening 82 is longer than the opening 74 allowing for the longitudinal movement of the safety bar 70 relative to the extension leg 22 and to serve as the stop. When a load is applied to the extension 10, the safety bar 70 is moved longitudinally in the first direction such that an edge of the opening 76 presses against the release lever 50, thereby holding the tip 62 in one of the locking nubs 60 creating a positive locking engagement preventing moving of the extension leg 22 relative to the outer housing 20.

Figure 13:
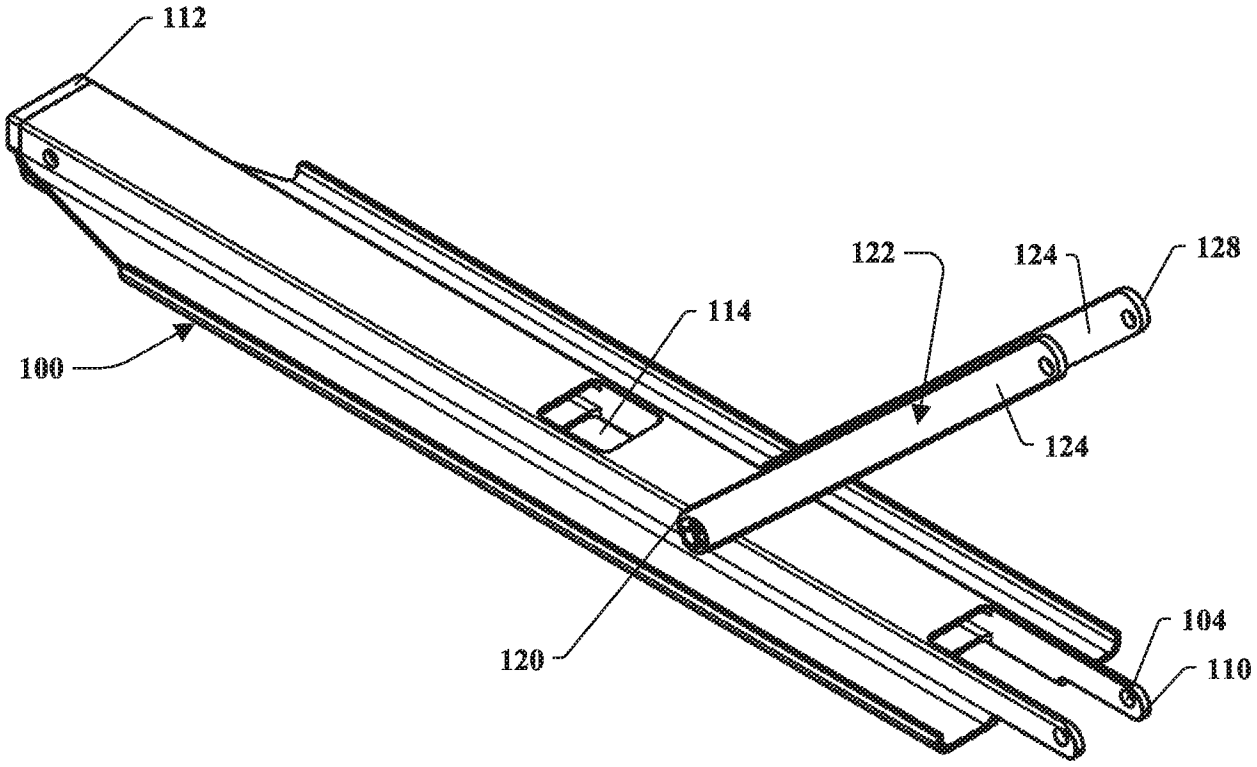
FIG. 13 is a perspective view of the stabilizer arm and brace extrusion.

Turning now to FIGS. 2 and 13, stabilization of the adjustable extension 10 will be discussed in detail. To provide stabilization, a stabilizer arm 100 is provided that is pivotally connected to the extension leg 22 by a pivot pin 102 extending through openings 104 such that the stabilizer arm 100 moves longitudinally with the extension leg 22 when stowed. The stabilizer arm may be connected to the extension leg near the foot 26, for example approximately four to twelve inches from the foot. In this way, the stabilizer arm 100 may have a fixed length and fixed pivot point near a bottom of the stabilizer arm 100 to avoid complications caused by telescoping stabilizers, reduces set-up time, and reduce weight, length, and travel distance of the stabilizer arm.

Figure 20:
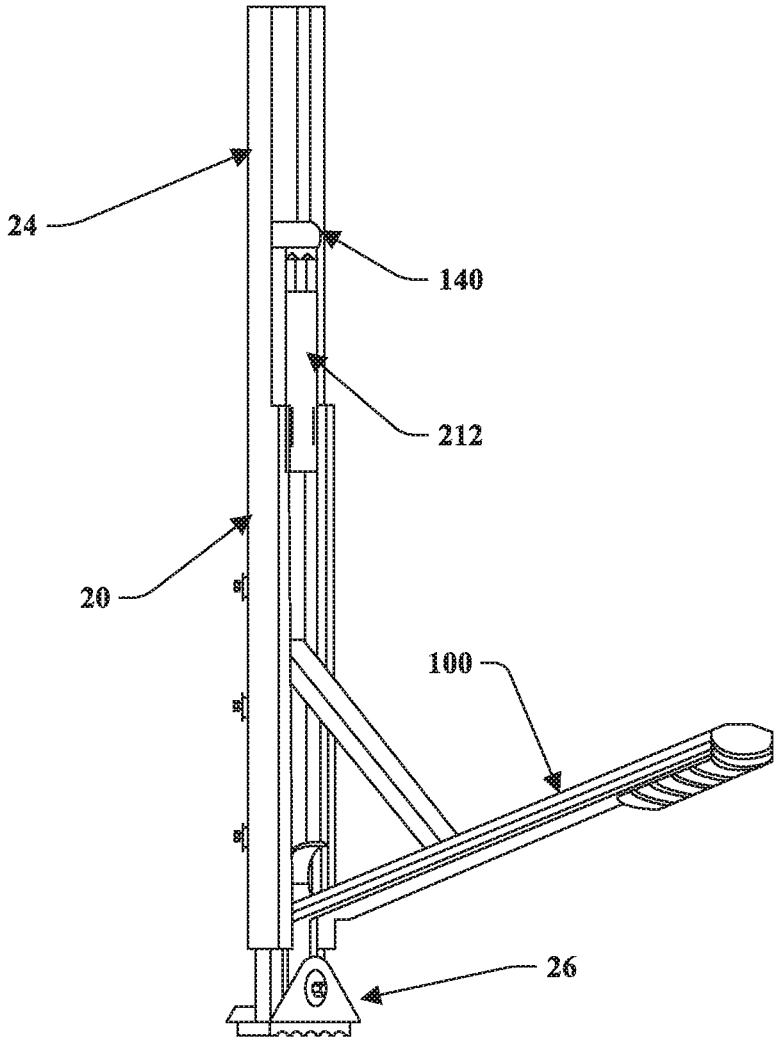
FIG. 20 is a perspective view of the adjustable extension with the stabilizer arm in another deployed position.

The stabilizer arm 100 is movable between a stowed position shown in FIG. 2, a deployed position shown in FIGS. 9 and 10, such as a downhill position, and a number of intermediate positions therebetween to provide stabilization at various angles, such as the deployed position shown in FIG. 20, such as an uphill position. The stabilizer arm 100 is freely movable but not lockable when no load is applied to the adjustable extension 10, and the stabilizer arm 100 is locked in the deployed position when a load applied to the extension 10. The stabilizer arm 100 is prevented from being moved from one of the deployed positions to the stowed position when the load is applied to the extension 10. In another embodiment, the stabilizer arm may be locked in the deployed position when no load is applied.

The stabilizer arm 100 has a first end or bottom 110, a second end or top 112, and an aperture 114. A shoe 116 is attached to the arm 100 at the second end 112 to prevent/reduce slipping of the arm 100 when deployed, and a torsion spring 118 surrounds the pivot pin 102 to help push the sides of the arm 100 up during stowing. The shoe 116 may be attached to the arm 100 in any suitable manner, such as by one or more fasteners, such as rivet 108 shown in FIG. 9A. The aperture 114 is aligned with the aperture 54 in the extension leg 22 when the stabilizer arm 100 is in the stowed position such that the release lever 50 extends through the aperture 114.

Figure 14:
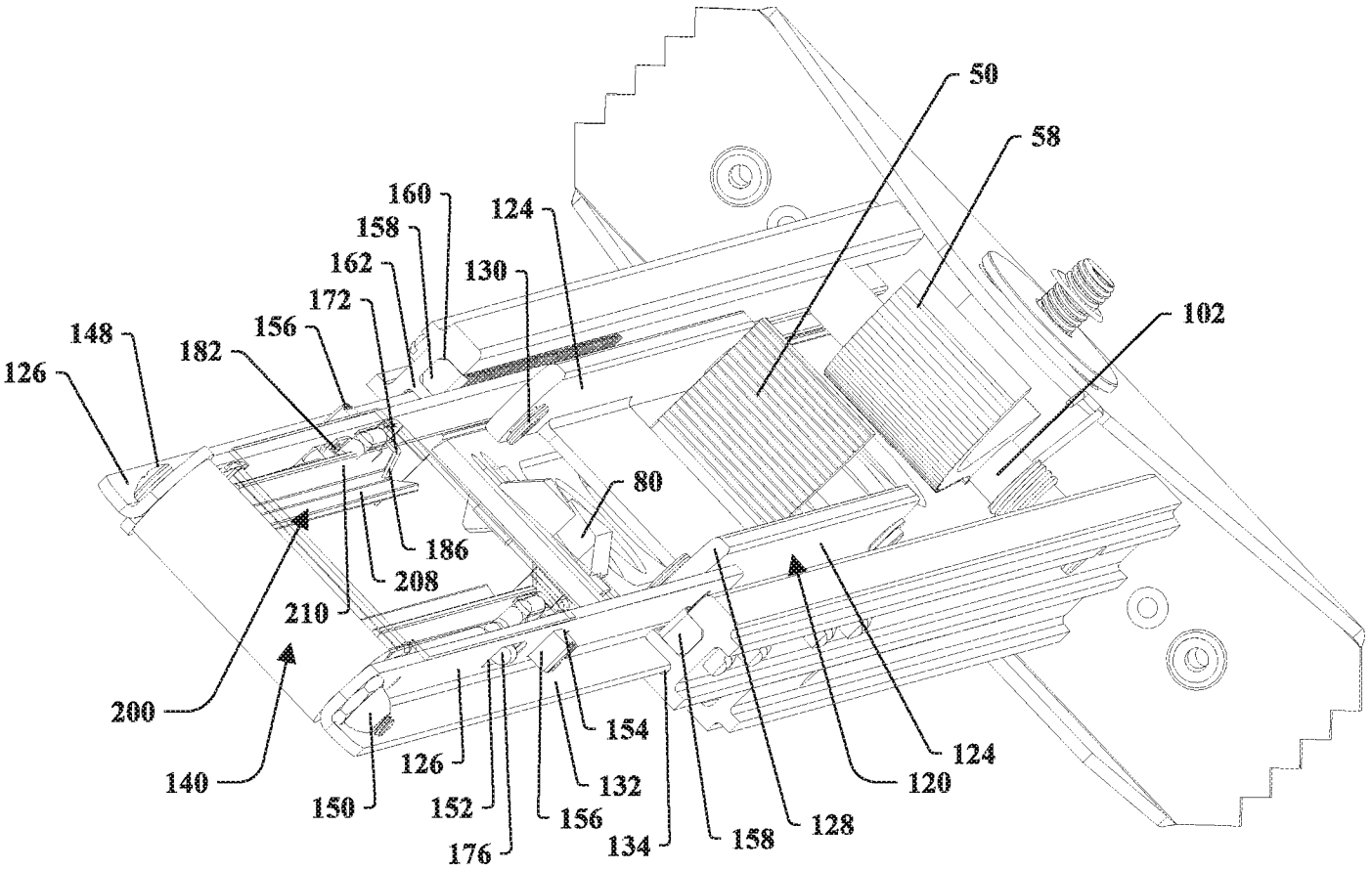
FIG. 14 is a perspective view of the adjustable extension without the stabilizer arm.

As noted above, the stabilizer arm 100 is pivotally connected to the extension leg 22 by the pivot pin 102 at the first end 110, which also connects the release pedal 58 to the extension leg 22. The stabilizer arm 100 is also pivotally attached near the first end 110 to a first end 120 of a brace extrusion 122 having a pair of spaced rails 124 that provide support to the stabilizer arm 100 and allow the arm to be thinner and lightweight. As shown in FIG. 14, each rail 124 is attached to a respective slide angle 126 at a second end 128 of the brace extrusion 122 in a suitable manner, such as by a respective bushing 130.

When the stabilizer arm 100 is moved to the deployed position, for example moved approximately one hundred thirty five degrees as shown in FIG. 9, the first end 120 of the brace extrusion 122 moves outward with the stabilizer arm 100 while the second end 128 moves longitudinally in the second direction towards the foot 26. The slide angles 126 and thus the second end 128 of the brace extrusion 122 are held longitudinally by outwardly extending portions 132 of the slide angles 126 that engage in channels 134 in the extension leg 22.

Figure 10A:
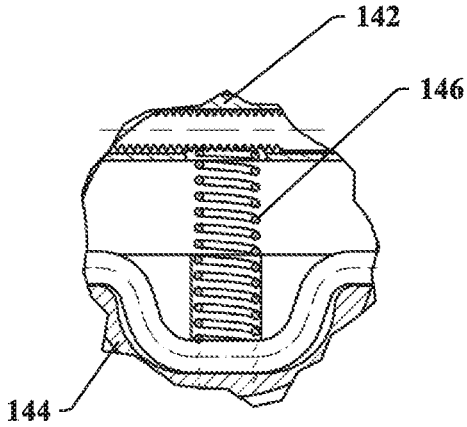
FIG. 10A is a cross-sectional view of detail 10A of FIG. 10.
Figure 11:
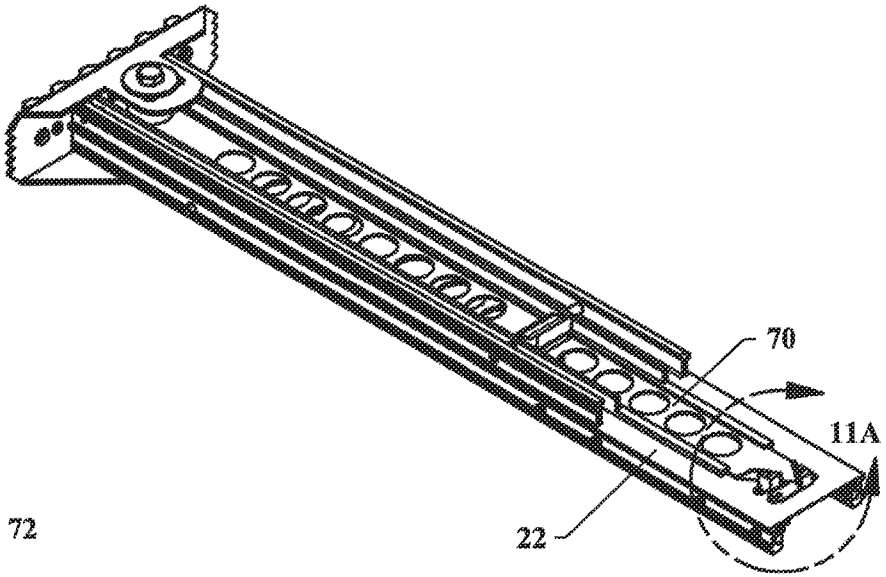
FIG. 11 is a perspective view of an extension leg, foot and safety bar of the adjustable extension.
Figure 11A:
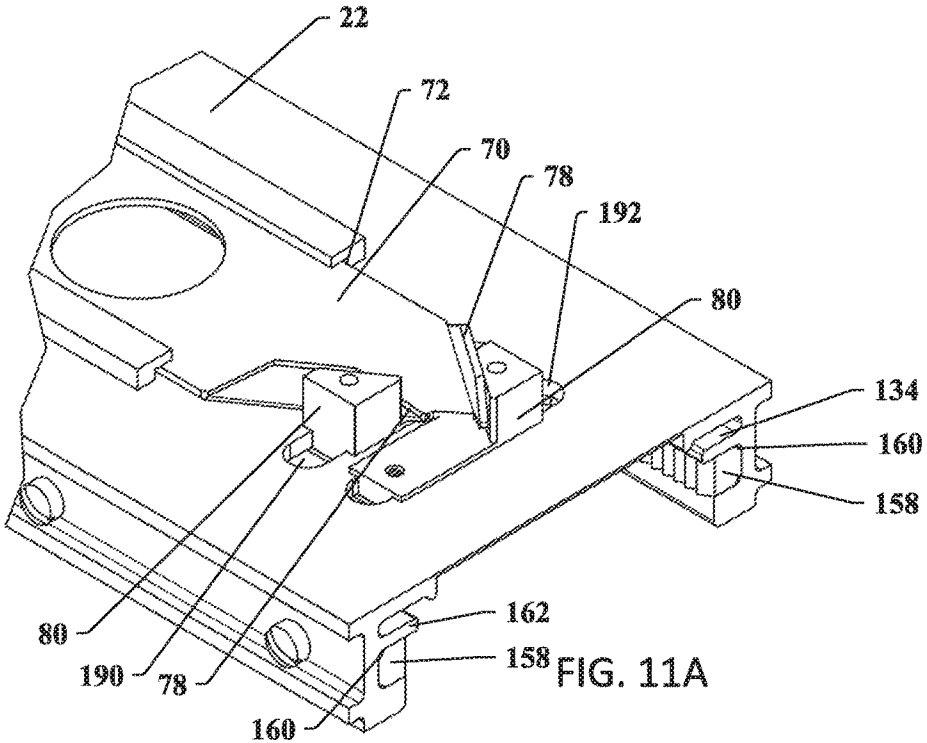
FIG. 11A is a cross-sectional view of detail 11A of FIG. 11.
Figure 12:
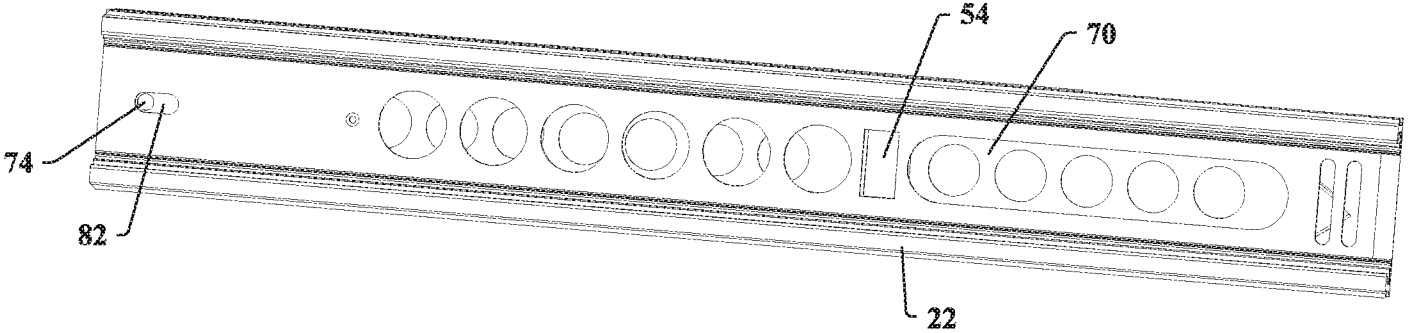
FIG. 12 is a front perspective view of the extension leg and safety bar.
Figure 15:
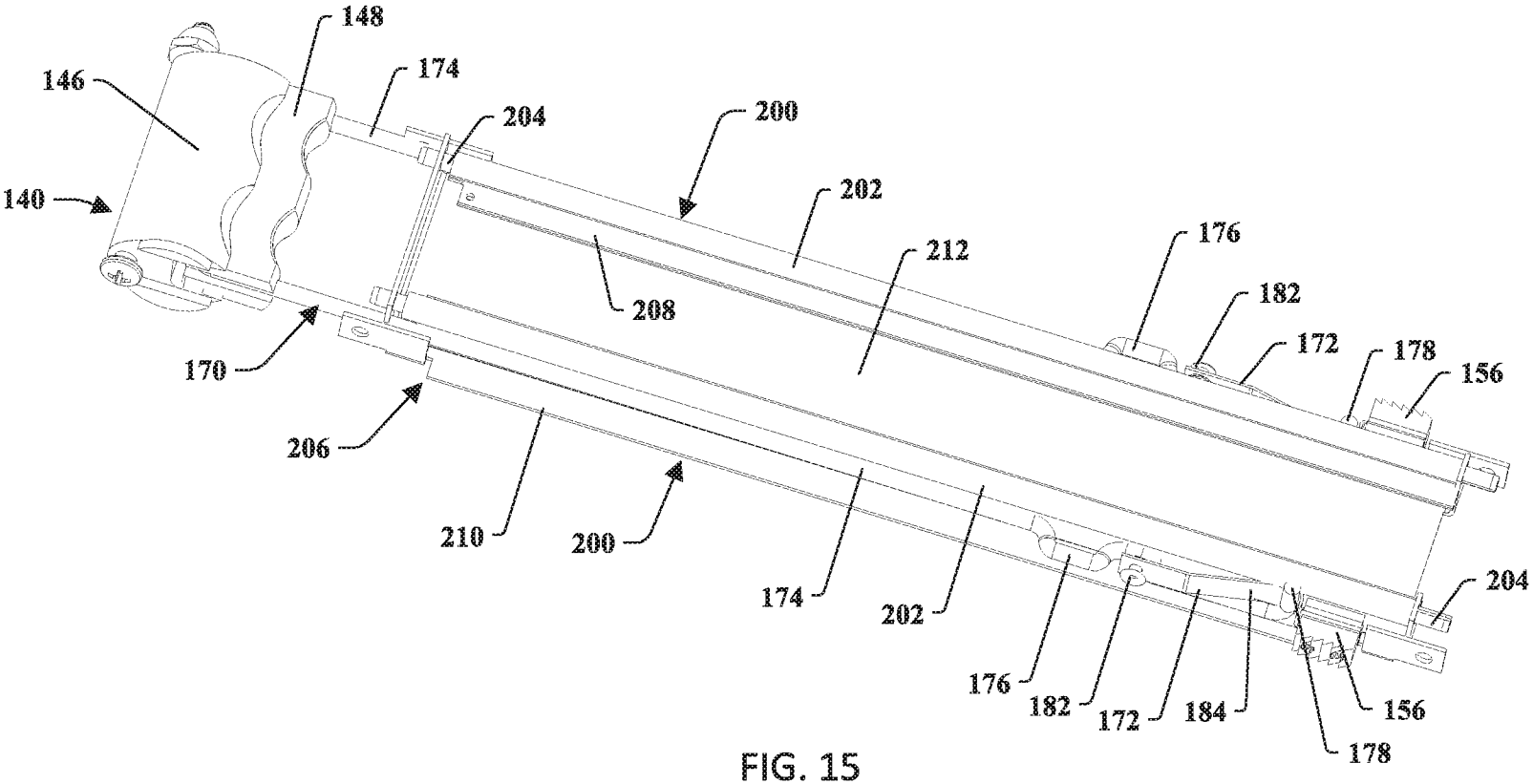
FIG. 15 is a back perspective view of a handle and safety mechanism of the adjustable extension.
Figure 16:
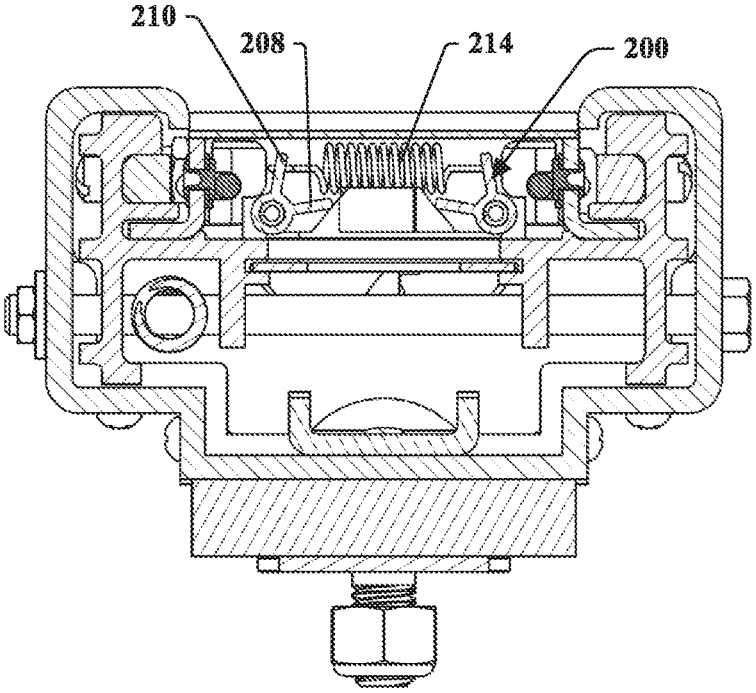
FIG. 16 is a cross-sectional view taken about line 16-16 in FIG. 10.
Figure 17:
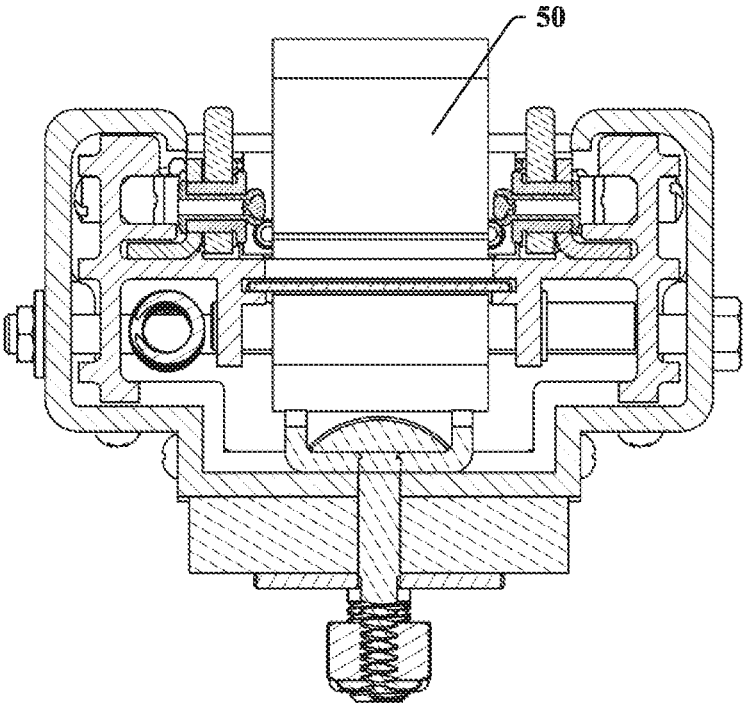
FIG. 17 is a cross-sectional view taken about line 17-17 in FIG. 10.
Figure 18:
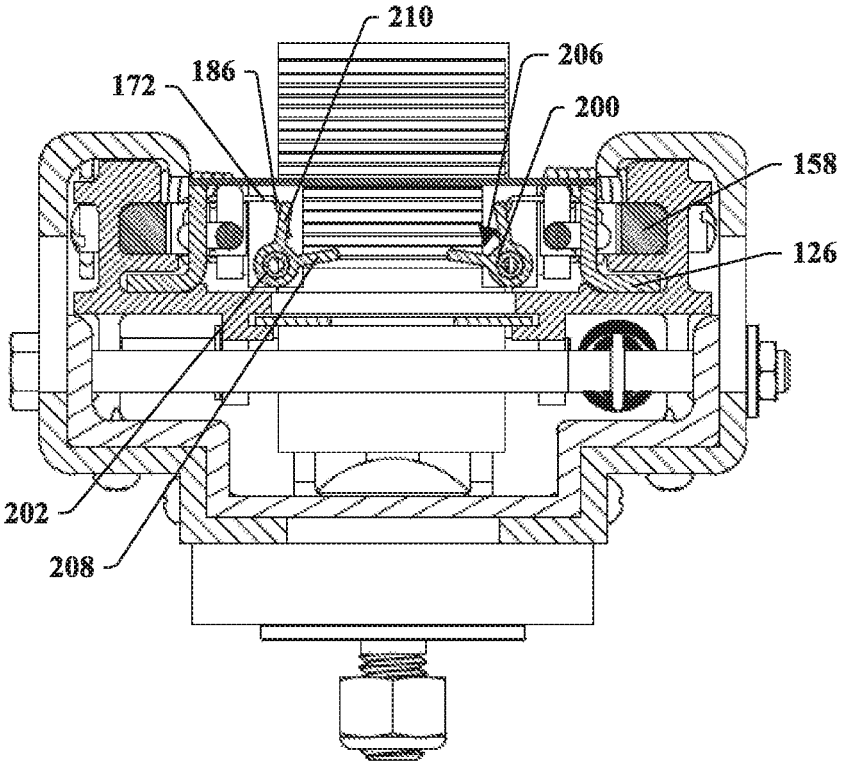
FIG. 18 is a cross-sectional view taken about line 18-18 in FIG. 10.
Figure 19:
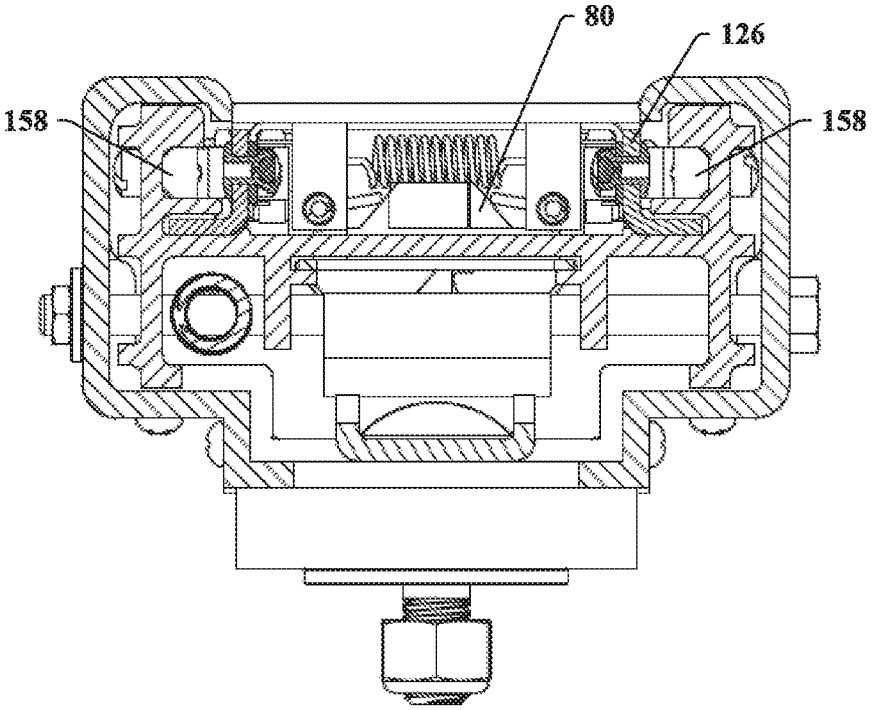
FIG. 19 is a cross-sectional view taken about line 19-19 in FIG. 10.

Referring now to FIGS. 14 and 15, the extension includes a handle 140 configured to be moved in the second and first directions to deploy and stow the stabilizer arm 100. The handle 140 includes a fixed handle portion 142 and a movable handle portion 144 surrounded by the fixed handle portion and biased away from the fixed handle portion 142 by a resilient member 146 shown in FIG. 10A. The fixed handle portion 142 is connected to ends of the slide angles 126 by a suitable fastener, such as by bolt 148 held by nut 150.

The slide angles 126 each include a first guide slot 152 and a second guide slot 154. A rack segment 156 extends through the second guide slot 154 in each slide angle 126 and is configured to engage a respective rail 158 connected to and disposed in respective channels 160 in the extension leg 22 when the stabilizer arm 100 is being deployed. In an embodiment, the channels 134 and 160 may be parallel to each other and each has a side formed by a shared wall 162. The rack segments and rails may be any suitable material, such as stainless steel.

To move the stabilizer arm 100 from the stowed position to one of the deployed positions when a load is applied to the extension 100, the user pushes downward on a handle 140. The downward movement pushes down the second end 128 of the brace extrusion 122 and pushes out the first end 120 of the brace extrusion 122 and the stabilizer arm 100. To move the stabilizer arm 100 from the deployed position to the stowed position when the load has been removed from the extension 100, the user moves the movable handle portion 144 towards the fixed handle portion 142, thereby disengaging the rack segments 156 from the rails 158. The user can then pull upward on the handle 140 in the first direction, moving the slide angles 126 and the second end 128 of the brace extrusion upward and causing the stabilizer arm 100 to pivot about the pivot pin 102 and return to the stowed position.

In the illustrated embodiment, to disengage the rack segments 156, the extension includes a wire release 170 and a pair of spring clips 172. The wire release 170 is substantially U-shaped, with a base of the U being disposed between the fixed and movable handle portions 142 and 144 and being moved by the movable handle portion 144, and with arms 174 of the U being substantially parallel with the slide angles 126. Each arm 174 includes an outwardly extending portion 176 that extends through the first guide slot 152 in the respective slide angle 126, and a curved end portion 178 trapped between the respective spring clip 172 and the respective slide angle 126. Each spring clip 172 has an end coupled to the respective slide angle 126 by a suitable fastener, such as rivet 182, an opposite end coupled to the respective rack segment 156 by a suitable fastener(s), such as screws, a ramp portion 184 therebetween, and a finger 186.

When the movable handle portion 144 is moved towards the fixed handle portion 142 when there is no load, the wire release 170 is moved towards the fixed handle portion 142, causing the curved end portions 178 to move along the ramp portions 184 deflecting the spring clips 172 inward. The inward movement of the spring clips 172 moves the rack segments 156 inward to disengage from the rails 158.

Referring now to FIGS. 11A and 14-19, the safety bar 70 provides a first safety feature discussed above of preventing movement of the release lever 50 to ensure the extension leg 22 is locked when a load is applied to the extension 10. The safety bar 70 also assists with a second safety feature of causing the rack segments 156 to engage the rails 158 and prevent movement of the rack segments 156 to ensure the stabilizer arm 100 is locked with the load is applied. When the safety bar 70 is moved longitudinally in the first direction when the extension is loaded, the angled tabs 78 of the safety bar 70 move the wedges 80 outward resulting in the rack segments 156 moving outward into engagement with the rails 158 when the rack segments 156 are moved in the second direction, for example when the arm 100 is at a desired angle relative to the extension leg 22. In the illustrated embodiment, the wedges 80 are movably secured to the extension leg 22 in respective slots 190 and 192 in the extension leg 22. Thus the wedges 80 are held in their outward positions by the safety bar 70, and can be moved inward when the load is removed.

In the illustrated embodiment, the wedges 80 rotate a pair of wing extrusions 200 causing the wing extrusions 200 to move the rack segments 156 outward, and the wedges 80 hold the wing extrusions 200 in position until the load is removed. The wing extrusions 200 each include a body 202 having a through passage for receiving a rod or spring pin 204, two of which are provided for each wing extrusion 200 in the illustrated embodiment, and a pair of substantially v-shaped wings 206 having an inner leg 208 contacted by the wedges 80 and an outer leg 210 that contacts the rack segments 156. The fingers 186 of the spring clips 172 guide the outer legs 210 and prevent over rotation of the wing extrusions. The wing extrusions 200 are connected to a hinge clip 212 that protects the components and that is connected to the slide angles 126, for example via the pins 204 received in openings in the hinge clip 212, and the wing extrusions 200 are pulled together at the end near the handle 140 by an extension spring 214.

When the load is applied and the stabilizer arm 100 is moved towards the deployed position, the wedges 80 contact the inner legs 208 to rotate the wing extrusions 200, causing the outer legs 210 to contact and urge the rack segments 156 outward to engage the rails 158 as the segments move in the second direction. The rack segments 156 then ratchet along the rails 158 until the extension arm 100 is in the desired deployed position, and the interaction of the teeth of the rack segments 156 and rails 158 prevent longitudinal movement of the rack segments 156 in the first direction. When the load is removed, the user moves the movable handle portion 144 relative to the fixed handle portion 142, thereby moving the rack segments 156 inward, causing the wing extrusions 200 to rotate and the inner legs 208 to move the wedges 80 inward. The extension spring 214 also serves to pull the wing segments 200 together to move the wedges 80 inward.

In addition although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The best mode for carrying out the invention has been described for purposes of illustrating the best mode known to the applicant at the time and enable one of ordinary skill in the art to practice the invention, including making and using devices or systems and performing incorporated methods. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A ladder comprising:

an extension leg configured to be attached to a rail of a ladder, said extension leg is movable longitudinally in first and second directions opposite one another;

a stabilizer arm pivotably coupled to and movable with the extension leg, the stabilizer arm having a first end pivotally coupled to the extension leg and a second end, the stabilizer arm being pivotable about an axis perpendicular to the first and second directions such that the stabilizer arm is rotated relative to the extension leg to contact a surface to stabilize the ladder in a sideways direction perpendicular to the first and second directions;

a shoe connected to the stabilizer arm at the second end and configured to contact the surface to prevent/reduce slipping; and a brace extrusion having a first end coupled to the stabilizer arm and movable in the sideways direction with the stabilizer arm, and a second end pivotally coupled to the extension leg above the first end of the stabilizer arm, said second end of said brace extrusion is movable longitudinally in the first and second directions when the first end of the brace extrusion is moved in the sideways direction.

2. The ladder according to claim 1, further including a handle coupled to the brace extrusion and configured move the second end of the brace extrusion in the second direction and force the first end of the brace extrusion to move in the sideways direction.

3. The ladder according to claim 1, further including a rack segment movable in the second direction to engage a rail coupled to the extension leg when a load is applied to the ladder.

4. The ladder according to claim 3, wherein the rack segment is configured to engage and ratchet along the rail in the second direction when the load is applied, and wherein when the load is applied the engagement between the rack segment and rail prevents movement of the rack segment in the first direction.

5. The ladder according to claim 1, wherein the stabilizer arm is pivotably coupled to the extension leg near an end of the extension leg configured to contact the surface.

6. The ladder according to claim 1, further including a release lever pivotably secured to the extension leg.

7. The ladder according to claim 6, further including a safety bar movable relative to the extension leg in the first direction when the load is applied to contact and hold the release lever to prevent the release lever from unlocking.

8. The ladder according to claim 7, wherein the safety bar includes one or more angled tabs, and wherein the safety bar is configured to move one or more wedges movably coupled to the extension leg outward to urge rack segments outward to lock the stabilizer arm.

9. A ladder comprising:

an extension leg configured to be attached to a rail of a ladder, said extension leg is movable longitudinally in first and second directions opposite one another;

a stabilizer arm pivotably coupled to and movable with the extension leg, the stabilizer arm being pivotable about an axis perpendicular to the first and second directions such that the stabilizer arm is rotated relative to the extension leg to contact a surface to stabilize the ladder in a sideways direction perpendicular to the first and second directions;

a locking hub rail;

a release lever pivotably secured to the extension leg and configured to engage the locking hub rail when a load is applied to lock extension leg; and a safety bar movable relative to the extension leg in the first direction when the load is applied to contact and hold the release lever to prevent the release lever from unlocking from the locking hub rail; and a brace extrusion having a first end coupled to the stabilizer arm and movable in the sideways direction with the stabilizer arm, and a second end pivotally coupled to the extension leg above the first end of the stabilizer arm, said second end of said brace extrusion is movable longitudinally in the first and second directions when the first end of the brace extrusion is moved in the sideways direction.

10. The ladder according to claim 9, wherein the safety bar includes one or more angled tabs, and wherein the safety bar is configured to move one or more wedges movably coupled to the extension leg outward to urge rack segments outward to lock the stabilizer arm.

11. The ladder according to claim 9, further including a handle coupled to the brace extrusion and configured to move the second end of the brace extrusion in the second direction and force the first end of the brace extrusion to move in the sideways direction.

12. The ladder according to claim 9, further including a rack segment movable in the second direction to engage the locking hub rail when a load is applied to the ladder.

13. The ladder according to claim 12, wherein the rack segment is configured to engage and ratchet along the locking hub rail in the second direction when the load is applied, and wherein when the load is applied the engagement between the rack segment and the locking hub rail prevents movement of the rack segment in the first direction.

14. A ladder comprising:

an extension leg configured to be attached to a rail of a ladder, said extension leg is movable longitudinally in first and second directions opposite one another;

a stabilizer arm having a first end and a second end and being a fixed length, the stabilizer arm being pivotably coupled to the extension leg at the first end and movable with the extension leg, the stabilizer arm being rotatable relative to the extension leg to contact a surface to stabilize the ladder in a sideways direction perpendicular to the first and second directions; and a brace extrusion having a first end coupled to the stabilizer arm and movable in the sideways direction with the stabilizer arm, and a second end pivotally coupled to the extension leg above the first end of the stabilizer arm, said second end of said brace extrusion is movable longitudinally in the first and second directions when the first end of the brace extrusion is moved in the sideways direction.

15. The ladder according to claim 14, wherein the stabilizer arm is pivotable about an axis perpendicular to the first and second directions.

16. The ladder according to claim 14, further including a rack segment movable in the second direction to engage a rail coupled to the extension leg when a load is applied.

17. The ladder according to claim 16, wherein the rack segment is configured to engage and ratchet along the rail in the second direction when the load is applied, and wherein when the load is applied the engagement between the rack segment and rail prevents movement of the rack segment in the first direction.

18. The ladder according to claim 14, further including a shoe connected to the second end of the stabilizer arm for gripping a surface when the stabilizer arm is in a deployed position.

* * * * *